United States Patent [19]

Erb

[11] 3,974,664

[45] Aug. 17, 1976

[54] METHOD AND DEVICE FOR ELECTRONIC SCANNING OF CONTROL-FIELDS OF A CONTROL MEMBER ON CYLINDER AND STRAIGHT BAR KNITTING MACHINES

[75] Inventor: Ernst Erb, Muri, Switzerland

[73] Assignee: Erba Maschinenbau AG, Aefligen, Switzerland

[22] Filed: Mar. 25, 1974

[21] Appl. No.: 454,575

[30] Foreign Application Priority Data

| | | |
|---|---|---|
| Mar. 25, 1973 | Switzerland | 4309/73 |
| Sept. 10, 1973 | Switzerland | 12959/73 |
| Dec. 31, 1973 | Switzerland | 18214/73 |

[52] U.S. Cl. ..... 66/154 A; 66/75 A

[51] Int. Cl.[2] ..... D04B 15/66

[58] Field of Search ..... 66/50, 154 A, 73

[56] References Cited

UNITED STATES PATENTS

| | | | |
|---|---|---|---|
| 2,153,342 | 4/1939 | Ruinnet | 66/75 |
| 2,157,989 | 5/1939 | Lawson | 66/75 |
| 3,262,285 | 7/1966 | Beguin et al. | 66/50 R |
| 3,365,916 | 1/1968 | Ribler et al. | 66/154 A X |
| 3,509,738 | 5/1970 | Flad | 66/75 UX |
| 3,518,845 | 7/1970 | DeCerjat | 66/50 R |
| 3,605,448 | 9/1971 | Ribler | 66/154 A |
| 3,695,060 | 10/1972 | Flad | 66/75 |
| 3,710,594 | 1/1973 | Bourgeois | 66/50 R |
| 3,733,855 | 5/1973 | Bliss-Hill et al. | 66/50 R |
| 3,812,691 | 5/1974 | Engelfried | 66/50 R |
| 3,818,728 | 6/1974 | Erb | 66/75 |

FOREIGN PATENTS OR APPLICATIONS

| | | | |
|---|---|---|---|
| 1,964,337 | 7/1970 | Germany | 66/75 |
| 73,369 | 1/1970 | Germany | 66/75 |
| 24,031 | 10/1962 | Germany | 66/75 |
| 1,002,549 | 8/1965 | United Kingdom | 66/75 |

*Primary Examiner*—Ronald Feldbaum
*Attorney, Agent, or Firm*—Wenderoth, Lind & Ponack

[57] ABSTRACT

A method of and apparatus for electronic scanning of control-fields of a control member on cylinder and straight bar knitting machines, in which the boundaries of the control-fields coincide with the boundaries of the needle pitches of the machine and electronic pulses are generated which are maintained during the run of the cam across a whole needle pitch or respectively across a number of whole needle pitches. The control pulses electronically amplified are fed to an obliquely positioned electromagnet or a piezoelectric movement-element having a wedge, arranged in a cam casing close to selector members, so that those selector members which coincide with a current pulse are moved away from the tips of inoperative members, a movement which arises both from the oblique guidance of the pole edges as well as the wedge. The tips of the members to be selected are removed so far from the tips of the inoperative members that before leaving the pole edges or before the magnetic pulse ceases at that point, a separator tip of a deflector connected with the cam passes behind the tips of each member thus preselected and thus secures a small separation, whereupon the deflector by its succeeding wedge drives the member towards the butt of the needle. Thus the tip of a foot of the needle moves behind the tip of the edge of the apex of a needle deflecton device, and the latter drives the needle into operation.

34 Claims, 35 Drawing Figures

Fig. 2a
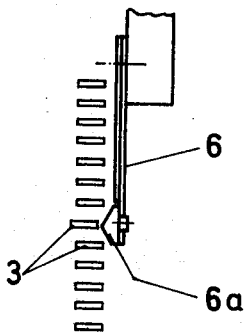
Fig. 3
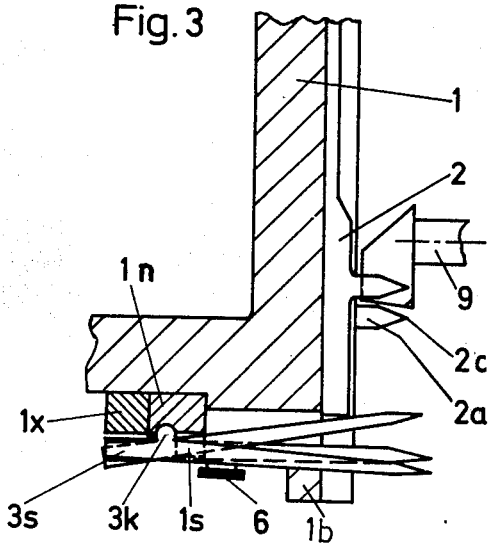
Fig. 4
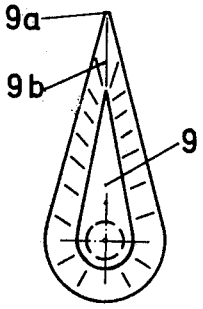
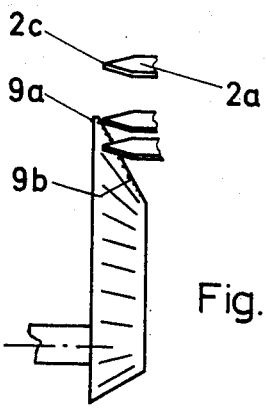
Fig. 6
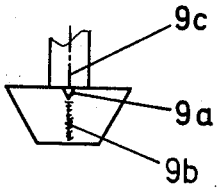
Fig. 5

63b
63d
63
63c
63a
B
63e
63f 75c
75b 73a
63a
A
74a
63c
74
73
64a
70
75
73a
64

75a
69a
64c
61a
65a
68
61
68b
65b
68a
62a
63d
63a
65e
62
60
60b
62a
67
64b
66
63
60d
65k
63e
60c
60e
71
73
74b
72
74c
72b
74
70
60
66
64a
66
66b
65d
60a
66c
65c
63b
64
65d
63a
77
76
66
C
67

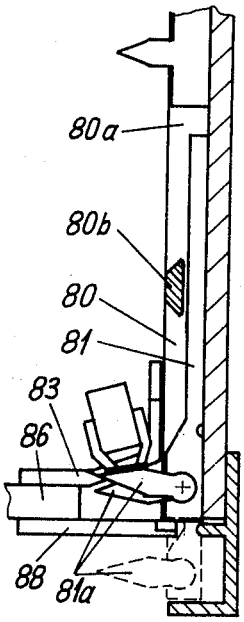
Fig. 26
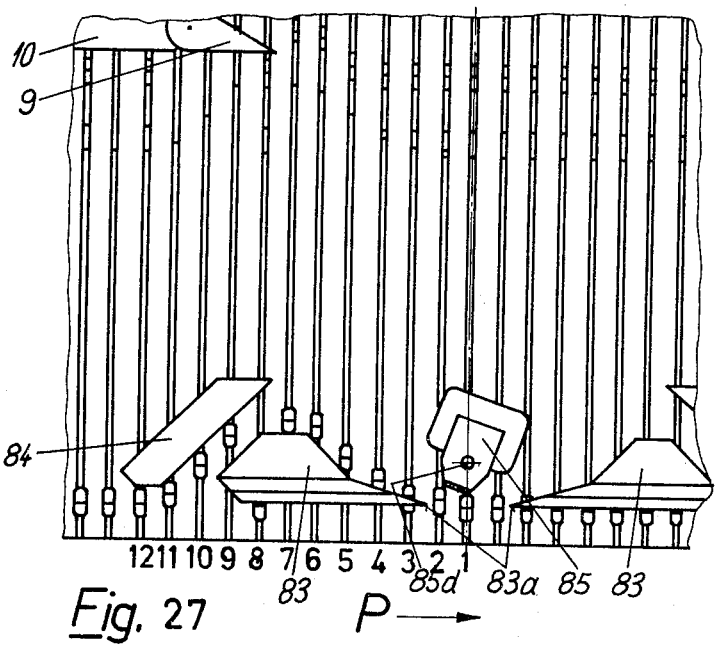
Fig. 27
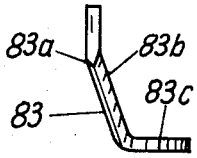
Fig. 25
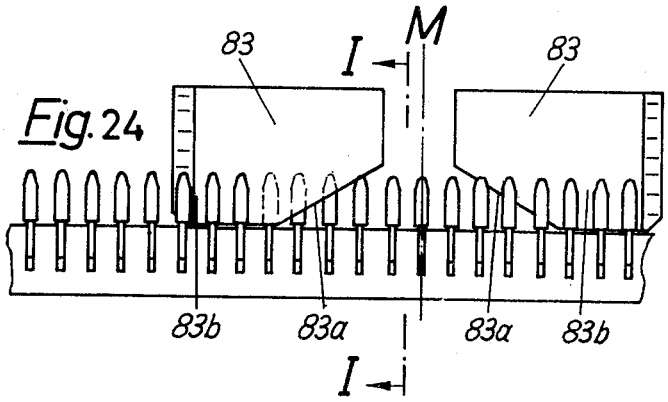
Fig. 24
Fig. 21
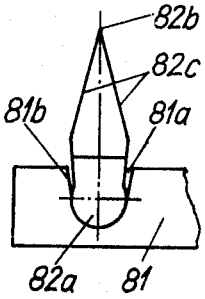
Fig. 22
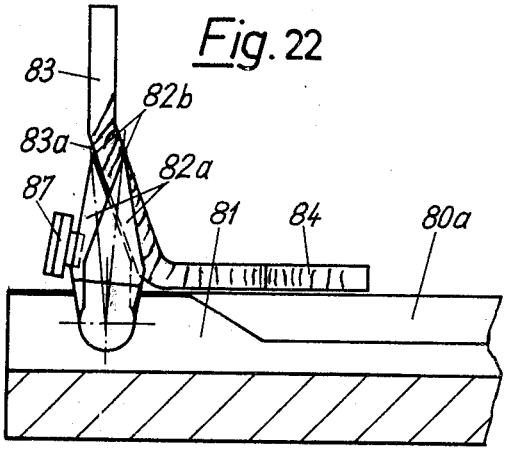
Fig. 23
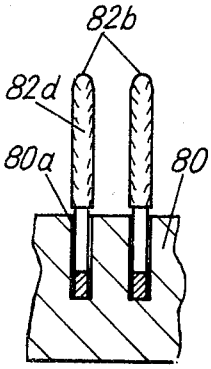

Fig.28
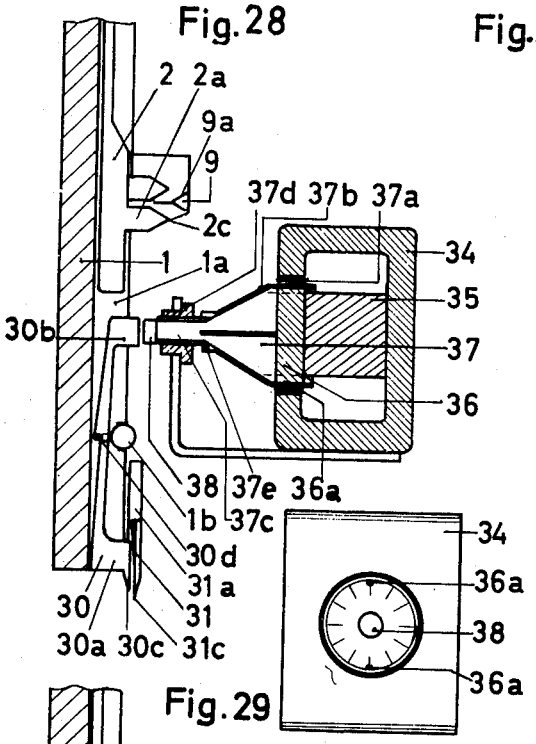
Fig.28a
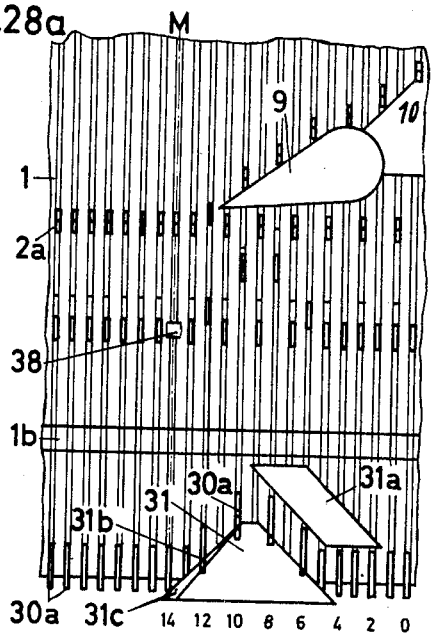
Fig.29
Fig.30
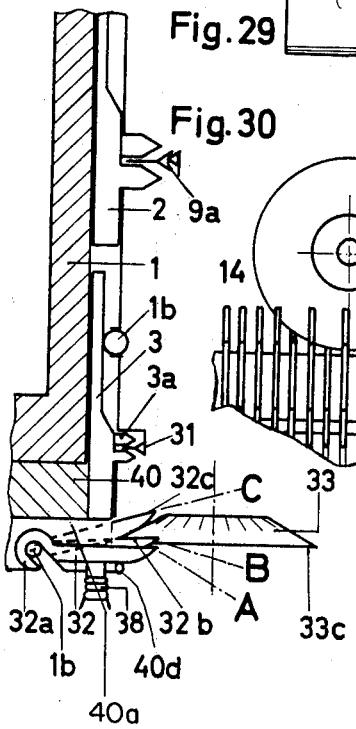
Fig.31
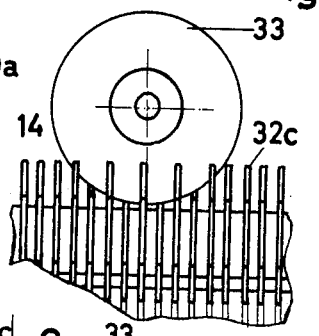
Fig.31a
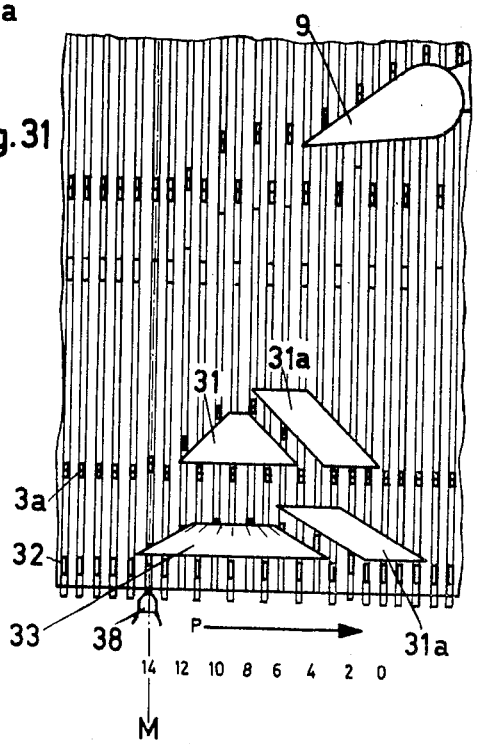

METHOD AND DEVICE FOR ELECTRONIC SCANNING OF CONTROL-FIELDS OF A CONTROL MEMBER ON CYLINDER AND STRAIGHT BAR KNITTING MACHINES

BACKGROUND OF THE INVENTION

This invention relates to a method and device for electronic scanning of control-fields of a control member on cylinder and straight bar knitting machines.

Instead of the generally known purely mechanical needle selector mechanisms for multi-system circular knitting machines as well as for straight bar knitting machines, recently various proposals have become known for electromagnetically or piezoelectrically acting needle selection mechanisms which act directly upon the needles themselves or upon pushrods in a conventional arrangement. These cannot however in most cases function because the distance of travel and the resistance of such conventional parts are too great.

The real obstacle which stands in the way of good functioning was in the case of many proposals to be attributed to this fact. Even the designers of successful new devices likewise keep adhering to tradition, in that they hitherto without exception further developed applied needle-pushrods with a special cam track. Thus there have resulted long pushrods and long needle travel distances, and thereby also long cylinders and in the case of straight bar knitting machines very wide needle beds. Also very complicated selection processes and also corresponding also parts for changing the sliders in and out in the pushrod cam have been employed, which through the long cylinder and the complicated auxiliary parts required per needle caused considerable increases in cost.

SUMMARY OF THE INVENTION

By the present invention a new concept has been developed, which enables by simple measures basically a great simplification of the selection mechanism, whereby even at the highest efficiency a reduction in cost of the machines is in addition achieved.

In recognition of the fact that in the case of the necessary high selection frequency (400 to 600 needles per second) only the shortest path of movement must be made for the preselection operation, be it by means of magnetic effect or by the effect of piezoelectric ceramic elements, a new method has been produced that is characterized in that the control pulses electronically amplified are fed to an obliquely set electromagnet or a piezoelectric movement-element with a wedge, arranged in the cam casing close to the selector members, so that those selector members which coincide with a current pulse, in order to be moved away from the tips of the inoperative members, make a movement which arises both from the oblique guidance of the pole edges as well as the wedge, so that the tips of the members to be selected are removed far enough from the tips of the inoperative members that before leaving the pole edges or before the magnetic pulse ceases at that point, a separator tip of a deflector connected with the cam passes behind the tips of the members thus preselected and thus secures separation, whereupon the deflector by its succeeding wedge shape drives the selected member towards the butt of the needle, and thus the tip of the foot of the needle moves behind the tip of the edge of the apex of the needle deflector and the latter drives the needle into operation.

The invention further embraces a needle selection mechanism for performance of this method, which is characterized in that behind the butt of needle one selector member each is provided, and which has inside the surface of the needle bed a fulcrum. A means of movement is provided behind the selector members, and connected solidly with the cam casing. Thus as the members move past the movement means in contact therewith, the preselector members which are to be moved by a selective movement receive a movement from the movement means. To achieve secure separation and further movement of the selected members a deflector is provided, which with its separator edge at this instant engages behind the tip of the selector member. The deflector has a wedge by means of which the selector members are driven from their preselected position towards the butts of the needles in order to bring the tips of the feet of the needles behind an edge of the apex of a needle deflector.

As the source of power of the movement pulse, in a first embodiment an electromagnet is provided, built onto the cam, both ends of the poles of which, lying one above the other, are arranged obliquely to the preselector members which move thereby, and these pole ends are only as wide as the boundaries of one needle pitch. The magnet receives from a control member via an electronic amplifying device current pulses which can be maintained from one boundary of a needle pitch to the other, or across one or a number of needles, the members to be preselected being attracted by the magnet during movement thereby and then over the path of one needle pitch being guided along the obliquely set edges of the poles. Thus, firstly the required movement occurs, and secondly the tips of the affected members lying further out by transformation along their length are removed so far from the tips of the unaffected members that a separation tip of a deflector can engage from above downwards between the tips of the members. The members thus preselected are then little by little moved by the separator wedge away from the preselected position mechanically towards the butts of the needles in order to feed the needles directly to the main cam for the purpose of knitting the pattern determined by the control member.

For straight bar knitting machines with the cam moving to and fro it is provided that the electromagnet has on its centreline a fulcrum about which, upon a change of direction of the cam, it can pivot so far that the leading edge of its poles lies exactly on the centreline which at the same time coincides with the boundary of the controlfield. The trailing edge of the poles coincides likewise with the terminal boundary of the needle pitch. Thus, functionally at the pivoting of the magnetic poles the boundaries of the control-fields must coincide with the boundaries of the needle pitch as well as with the start of the edges of the poles in both directions of movement, so that the preselection movement by the obliquely set magnet-poles takes place.

With another embodiment which is intended specially for fine pitches, i.e. pitches which demand a very high selection frequency, a piezoelectric ceramic element is advantageously provided as the power source for the movement pulse, which is connected with a spring steel strip. Such an element acts by means of a current pulse like the known bimetallic strips under the influence of temperature, only in this case the required movements of the spring steel strip can be controlled with very high frequency. In this embodiment it is provided that the steel strip has at its free end a wedge face which is arranged close behind the point of action of the selector members brushing therepast.

At each current pulse the piezoelectric movement-element so formed makes a deflection towards the point of action of the member to be selected, so that the wedge face of the movement element produces in the member to be preselected a small deflection which is magnified a number of times at the tip of the preselector member. The separator tip of a deflector which is connected with the cam passes at this instant from the outside in between the tip of the respectively preselected member and the tips of the non-selected members in order subsequently to move the preselected members by the deflector itself mechanically towards the butts of the needles.

Another important feature of this device involves the fact that on the one hand the needle feet each have a tip at an angle of about 40° to 50°, and that on the other hand a special needle-deflector is coupled to the lifter of the lifting cam, which by means of an obliquely sloping edge of its apex is provided for separation of the tips of the feet. Due to this measure the selected needle must only be moved over a small distance by the member to be securely moved by the edge of the apex of the needle deflector, from the tip on. Due to the pointed feet on the needles and the pivotable needle deflector at the entrance to the cam, equipped with an oblique-edged apex, the selected needles are fed with a short path of adjustment to the knitting cam. This innovation dispenses with all pusher cams so that the needle beds or needle cylinders respectively can be kept extremely short, which yields a great saving. With the new control member, which is explained in more detail later, a simpler pattern technique is also achieved.

In one embodiment, a control member for pattern storage is an endless belt with endless rows of rectangular white and black controlfields, lying axially one above the other. These rows of reflecting and non-reflecting control-fields are read during movement by photoelectric reflex scanners, and the resultant electronically amplified current pulses are transmitted to the selector magnet or to the piezoelectric ceramic element. New here is that the boundaries of the control-fields coincide in time with the boundaries of the needle pitch and at the same time with the edges of the poles of the selector magnet.

It is however now further provided that for all needle pitches the length of the control-fields is the same, e.g., 2 to 3 mm. This is achieved by the fact that for all pitches the gearwheels which drive the feed-cylinder have the same number of teeth, e.g., 24, but that the modulus of the teeth is matched to the corresponding needle pitch of the machine. It is thereby achieved that for all needle pitches the same diameter of the feed-cylinder can be employed as well as the same pitch of the feed-holes in the belt. Thus, for the production of the belts for all needle pitches only one device is needed, a measure that confers immeasurable savings.

Especially in the case of straight bar knitting machines the pattern is significantly less expensive, since instead of previously used expensive stamped steel sheets, only short endless belts are needed, the repeat of the pattern of which can be repeated a number of times across the whole width of the machine. With multi-system straight bar knitting machines it is moreover provided that for each system a separate selector mechanism is applied. It is further provided that the control mechanism and selector mechanism are united in one block which is guided underneath the knitting cam on a slidebar. On this block the control unit and the selector magnet together are so united that the scanner member of the control member lies on one boundary of the control-field, and the starting edge of the selector magnet as well as the boundary of the needle pitch lie on the same line. In this way, upon a change of direction of the cam, the block can slide from one cam entrance to another without the coincidence of the four points being altered, an operation which is to take place through an automatic coupling mechanism by means of appropriate stops. Thus, it is achieved that all the patterns of every repeat can be knitted in the desired width.

Besides the advantages described above there must be mentioned the very simple pattern storage as well as the extremely rapid exchange of pattern belts.

BRIEF DESCRIPTION OF THE DRAWINGS

A needle-selection mechanism representing a preferred embodiment of the invention will now be explained in greater detail below with the aid of the accompanying drawings wherein:

FIG. 2*a* is an enlargement of a piezoelectric movement element seen in a direction perpendicular to the member, FIG. 3 is an example of a support for the member in a circular knitting machine, FIGS. 4, 5 and 6 are respectively plan, side elevation and front elevation views of a needle-deflector, FIG. 21 is a detail of a pushrod with a rocking member instead of a rigid foot, FIG. 22 illustrates rocking members in axial elevation, in cooperation with a separator edge, FIG. 23 is a front elevation of rocking members, FIG. 24 is a front elevation of rocking members in cooperation with a separator edge of the deflectors, FIG. 25 is an elevation of a deflector along the line I—I in FIG. 24, FIG. 26 is a section through a needle-bed with the selector mechanism, FIG. 27 is a plan of a detail of a needle-bed with the selector mechanism, FIG. 28 is a partial section through a cylindrical needlebed with the arrangement of a moving coil, FIG. 28*a* is a partial plan of a needle-bed, FIG. 29 is an elevation of the moving coil and the magnet yoke seen from the operating wedge, FIG. 30 is a partial section through a cylindrical needlebed with rockerlike selector members, with a perpendicularly movingcoil and a separator roller, FIG. 31 is a partial plan of a needle-bed, and FIG. 31*a* is an elevation of FIG. 30 and FIG. 31 taken from below.

DETAILED DESCRIPTION OF THE INVENTION

Figure 1:
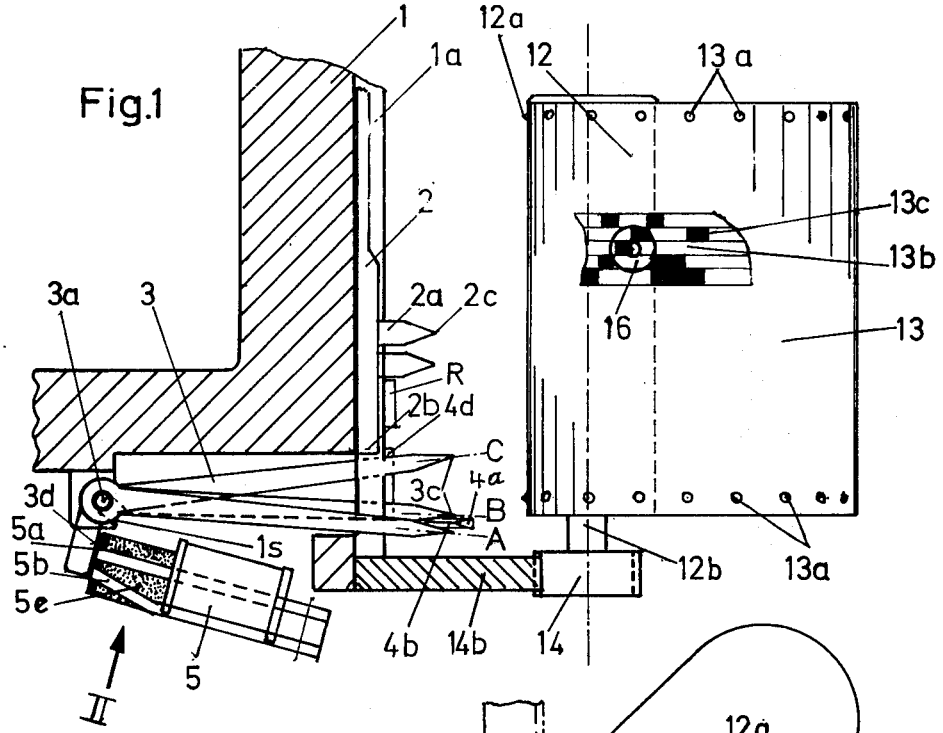
FIG. 1 is a partial section through a cylindrical needlebed of an embodiment of the preselector member.

As FIGS. 1, 2, 3 and 10 show, behind or beneath the butt 2*b* of each needle, approximately perpendicular to the needle track 1*a* passing along the needle cylinder 1, there is provided one selector member 3. Each selector member 3 is in the form of an oscillating rocker (from now on this selector member is only designated "member 3"). The member 3 has a fixed fulcrum 3*a*. From this fulcrum the member 3 includes a shank 3*b* which is extended through the needle track out beyond the needle-bed and ends in a tip 3*c*. Close to the fulcrum is provided a point of application 3*d* for the pole of the electromagnet 5, see FIG. 1, or for a wedge 6*a* of a piezoelectric movement-element 6, see FIG. 2. In FIG. 1 this point of application is located on a projecting lever portion in order to enable favourable arrangement of the magnet 5.

In FIG. 1 the line A shows the normal position, the line B the preselection position, and the line C the final position of the member 3, in which the needle 2 has arrived with the tip 2*c* of its foot behind the tip 9*a* of the peak of a needle deflector 9. From this position the member 3 is pushed by a wedge 4*d* back into its normal position and upon entry into the next cam system is aligned by a guide-piece 7 in order to direct it closely past the selector force member 5 or 6. Into this normal position all the members 3 are wiped by the wedge 4*d* after they have pushed the needles 2 into operation. The line B also shows the instant at which the change of position of the member 3 caused by the oblique edge of the magnet has been carried out and the separator tip 4*a* of the deflector 4 enters obliquely downwards behind the tip of the selected member 3, in order to separate the preselected member 3 with certainty from the unaffected members 3 (see also FIGS. 2 and 10).

The line C shows the final position of the member 3 as moved to shift the respective needle. In order that this shift may be kept small it is provided that the foot 2*a* of each needle is provided with a tip 2*c* pointing upwards by about 50° to 60° and that in front of the raising part of a cam a special needle-deflector 9 is provided, which is to be described in greater detail below with reference to FIGS. 4 to 6.

Figure 1B:
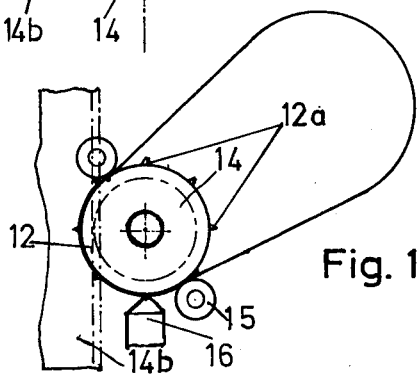
FIG. 1*b* is a plan of the control member of FIG. 1.
Figure 1A:
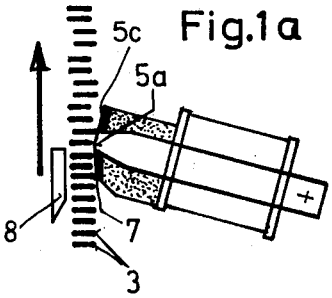
FIG. 1*a* is a detail of the electromagnet 5 seen in the direction of the arrow II in FIG. 1.

At the entry to each cam underneath the actual cam track and connected rigidly to the cam casing is provided a selector magnet 5 with a U-shaped core the poles 5*a* and 5*b* of which are set at about 15° to 30° to the row of members 3 or can respectively be shaped obliquely (see FIG. 1*a*). The two magnet poles lying one above the other converge together slightly at the front as may be seen in FIG. 1, in order to achieve with the armature portion 3*d* of the member the strongest possible magnetic field.

The obliquely set trailing-edge of poles 5*a* and 5*b* must at any pitch only reach from the beginning of one needlepitch to the end thereof. At that point it stops in a sharp edge, so that the members 3 detach easily when the magnetic impulse persists across a number of needles. The start of an edge of the pole is protected in front by a guidepiece 7 of non-magnetic metal. Behind the members 3 resting in their normal position a guide strip (not shown) is provided, connected rigidly to the cam casing, up to the poles of the magnet, in order to guide the members 3 past the pole of the magnet in the aligned state, so that separation takes place accurately.

The process of needle selection is as follows: The members 3 on the revolving cylinder upon leaving a cam are aligned by guidepieces and guided past the obliquely placed poles 5*a* and 5*b* of the magnet. The members 3 corresponding to the needles to be selected are pulled up by the magnet and dragged along the obliquely running pole edge 5*c* across one needle pitch (see FIGS. 1 and 1*a*). This effects on the member 3 a small movement in the direction B which results in movement of the tip 3*c* of the member by a distance of 1 to 2 millimeters. Before the termination of the magnetic adherence at the end of the pole edge to the member 3, a tip 4*a* of a deflector 4 is positioned between the tip 3*c* of the preselected member 3 and the tips 3*c* of the unaffected members so that the preselected member remains with certainty in its preselected position. The edge 4*b* of the tip is steeply inclined to the wedge 4*c* of the deflector 4, so that the oblique edge 4*c* of the deflector forces the member 3 towards the butt 2*b* of the needle and drives the tip 2*c* of the foot 2*a* of the needle over the edge 9*b* of the peak of the needle-deflector 9. The succeeding wedge 4*d* after the selection process brings the member 3 back again into its normal position A. Between the normal position A of the member 3 and the butt 2*b* of the needle, depending upon the needle pitch a free play of 2 to 3 millimeters is provided by a straightener (not shown) during straightening of the feet of the needles, so that the magnet poles piezoelectric elements respectively do not have to undertake any sliding work on the needles. On this account the source of power can be extremely small and operation can be by low-voltage current.

FIG. 1*a* shows an elevation of the electromagnet 5 in the direction of the arrow II of FIG. 1. The members 3 move with their armatare portions 3*d* in the direction of the arrow adjacent the obliquely lying edge 5*c* of the pole. Those members 3 which during their passage along the edge of the pole receive a magnetic impulse are attracted at their armature portion and through being dragged along the obliquely set edge of the pole their tips are pivoted into the position B (see FIG. 1). Through the transformation by the length of the shank there results at the tip 3*c* a sufficient deflection so that shortly before the end of the movement a separator tip 4*a* of the edge 4*b* of the apex of a deflector 4, leading obliquely downwards can engage from above between the tips of the preselected members and those of the unaffected members 3. Then the preselected members are moved mechanically by means of the adjoining wedge 4*c* towards the butts 2*b* of the needles.

In the present invention one factor is particularly important, namely: that the selector members 3 need only a very small power to be moved from their rest position A to the preselected position B. From then onwards they are actuated mechanically by the wedges 4*c* and 4*d*.

Between the edges of the poles and also outwardly thereof another antimagnetic bonding material 5*e* such as, e.g., hard metal, is provided, which helps to prevent abrasion of the edges of the poles and to provide a guide 7 for the members 3.

Thanks to the sintered magnet core material which has come to be known and the bonding material 5*e*, and in spite of the high frequency of the attractions, a high resistance of the edges of the poles to abrasion can be achieved, so that the relatively small magnet poles attain a sufficiently long working life.

As a rule with circular knitting machines the needle cylinder revolves while the parts of the cam are connected rigidly to the frame. In this case the selector members also revolve with the cylinder, while the magnets 5 as well as the deflector 4 and the respectively associated control unit are accommodated in the stationary cam casing (not shown).

Figure 2:
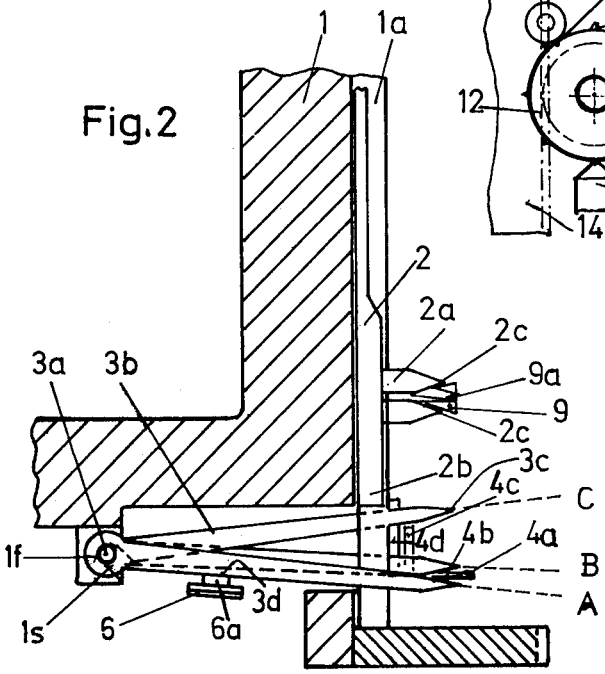
FIG. 2 is a partial section similar to FIG. 1, but of an embodiment of the preselector member for piezoelectric selection.

In the case of the application of piezoelectric ceramic elements 6 as is shown in FIGS. 2 an 2*a*, a small wedge 6*a* of hard metal or sintered ceramic is provided fixed to the free end of the piezoelectric movement element. There are variously shaped piezoceramic elements the motion-giving characteristics of which can be employed. The preselector members 3 brushing past are acted upon by means of the wedge 6*a* as FIG. 2*a* shows. In FIGS. 1 and 2 the members 3 are mounted by an endless spiral spring 1*f* which is laid taut in a grove 1*n* pointing obliquely towards the centre of the cylinder.

In the case of very fine pitches, however, very high demands are put upon the accurate supporting of the members 3. In order that the small movement effects of the magnet 5 or the piezoceramic element 6 respectively should not or not even partially be absorbed by the play at the fulcrum, it is provided in the embodiment of FIG. 3 that the member 3 in the direction of the centre of the cylinder has a round head 3*k* and an endpiece 3*s*. The head which is seated underneath the radial guide-slot 1*s* in a concave groove 1*n*, the radius of which isgreater by a few hundredths of a millimeter than that of the head 3*k*, is thus guided without play. Under the endpieces 3*s* around the whole circumference of the cylinder, bar permanent magnets 1*x* are arranged which pull the members 3 across an airgap continuously into the groove 1*n*. Members 3 contact an end-ring 1*b* in their rest or normal position. In this way the members 3 are guided very accurately and moreover can still be very easily dismantled and exchanged.

For controlling the selector elements 6 of any needle selector mechanism, be it for circular or straight bar knitting machines, an endless control member 13 is provided which is fed forward on a feed-cylinder 12 (see FIGS. 1, 1*b*, 10 and 11), while it is driven by a gearwheel 14 with the same pitch as the needle-bed or needle cylinder respectively. As a carrier for the control member 13 a cylinder 12 with guide-pins 12*a* is provided. The control member itself is an endless belt 13 with known guide-holes 13*a* for reliable feed by pins 12*a* of the cylinder 12. In contrast to known belts which for the purpose of pattern storage normally have perforations, it is provided in this case that the surface is divided up into rectangular control-fields 13*b* and 13*c* the boundaries of which in terms of time correspond in development (direction of running) exactly with the boundaries of the needle pitches. Control pulses can be generated opto-electrically, because the control-fields 13*a* and 13*b* are formed of contrasting colours and are scanned photo-electrically. The weak electrical pulses resulting therefrom are thereafter amplified electronically and fed to the selector element 5 or 6, which operation is known and thus will not be explained here in greater detail.

The novelty of the above control member quoted consists in the fact that the electrical pulses can be maintained in the simplest way across a whole needle-pitch because the boundaries of the control-fields, even if they are reduced or enlarged compared with the needle pitch, can be brought by the gearwheel 14 into conformity with those of the needle pitch. The effect of the selector magnet 5 on a member 3 to be selected thus persists over the whole length of its obliguely set pole. In that way it is also possible to maintain the control pulse across a number of pitches by the relevant controlled fields being arranged in a row together without visible boundaries!

For each needle selection mechanism there is provided for the purpose of the drive of the feed-cylinder 12 a gearwheel 14 matched to the pitch, but which however always has the same number of teeth. In that way on every machine, whatever the pitch, cylinders with the same diameter can be employed. Hence the possibility is created of employing for all needle pitches control members with the same graduation of the control fields, which will operate extremely advantageously for the future. The production of these new control members is more favourable in price, since the whole of the devices have to be constructed for only one pitch of the control-fields. The advantages of these measures operate also on the scanning members. These parts can likewise be reduced to one single standard execution.

The control fields 13*b* and 13*c* can be bounded in the axial direction as narrowly as the opto-electrical scanning allows.

The control members are read by the opto-electrical scanning mechanism in such a way (not shown), that the scanning member after each knitted row of loops is switched from one row of control-fields to the next. In order with automatic machines to enable simple continuous switching of the scanning-head 16 from top to bottom and from bottom to top, it is provided that on the belt 13 in each direction only every other row is employed as storage for the pattern, namely: in the downwards direction the odd-numbered rows and in the upwards direction the even-numbered rows, or vice versa.

With circular knitting machines the switching of the scanning-head from one row to another is performed at the seam of the machine, and in the case of straight bar machines at both sides, or when the carriage runs out of the needle-field. The switching mechanism does not, however, have to be explained here in greater detail.

All the mechanisms further needed for reducing the cost of Jacquard cards are dispensed with, since now the rows of control-fields are provided very inexpensively.

Since with Jacquard knitting in colours each cam is allocated its own colour, the corresponding control member can be formed in the simplest manner. The pattern as well as the change of a pattern can with far greater latitude be designed significantly more simply and cheaply than previously.

The association with the transfer cams of straight bar knitting machines of a selector unit as described above is also provided, in order to control the needles. In that case the control member would have to exhibit as many control-fields in one row as the piece of knitting is to have loops in its greatest width.

Figure 10:
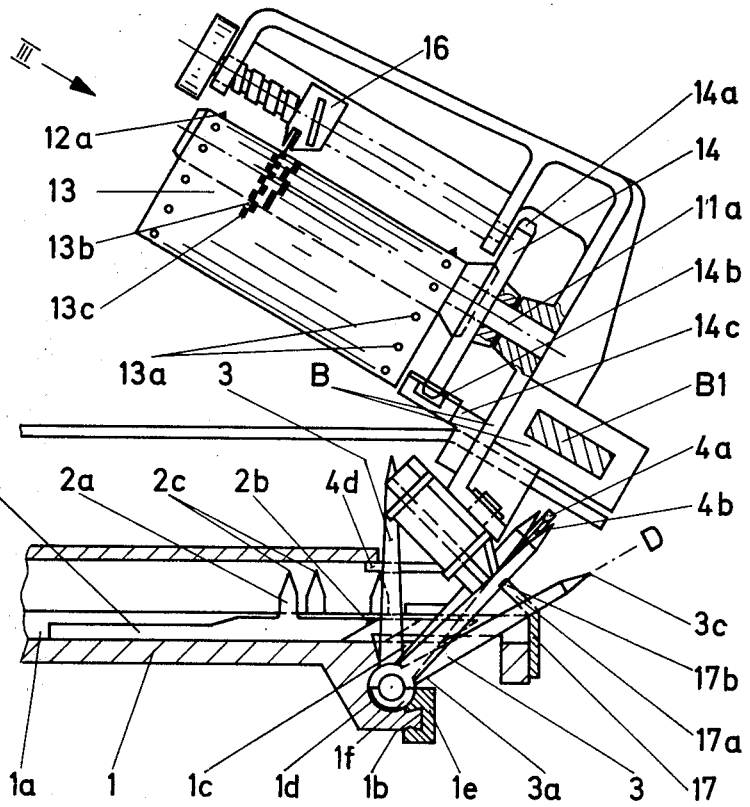
FIG. 10 is a section through a needle-bed with the cam movable backwards and forwards wherein needles can be put out of action.

In FIGS. 1 and 1*b* a control member for photoelectric reflex scanning is provided, while in the embodiment of FIG. 10 a control member is provided with conductive and non-conductive control-fields. The latter control member is known and thus will not be explained here in greater detail. Both exhibit the advantage that the control signals can be maintained from one boundary of a needle pitch to the other and that the control-fields for all pitches can be equally large.

The photoelectric scanning system will not be mentioned in greater detail at this point, since different types are already sufficiently well known, such, e.g., as systems operating on the transmitted light principle.

The most important features of the new measures described above with reference to the control member are:

1. that the development of the control-fields, or the reading thereof with respect to a rotating cylinder in the direction of the movement of the cam is effected across control-fields the boundaries of which coincide exactly with those of the needle pitches, 2. that the control-fields for all pitches are provided equally large, because the number of teeth on the driving-gears or pins 12*a* is the same for all needle pitches, but that the pitch of the teeth is matched to the needle pitch, 3. that the control-fields, however, short or long they may be, maintain the current pulse across the whole span of one or a number of needle pitches.

In FIGS. 4, 5 and 6 a needle deflector 9 is shown enlarged, and which in cooperation with the pointed feet 2*c* of the needles gives a reliable separation of the needles, even if they are displaced only slightly by the selector mechanism. This needle-deflector 9 consists of a pivotable wedge which has a raised tip 9*a* which lies slightly above the tips 2*c* of the needle feet 2*a*. From this tip 9*a* a slightly rounded edge 96 of the apex leads obliquely, toward the needle bed. Thanks to this edge 9*b* of the apex leading obliquely downwards to the plane of the needles it is achieved that always only the narrowest points can meet one another. Through the oblique position in the horizontal plane at the needle bed the first point of contact is either passed over or the needle foot is displaced by a small angle of attack starting at its tip, because the polished edge of the apex at first is not very deep, then engages, however, more and more deeply at its flank which is increasing in thickness, against the needle foot, as FIG. 5 shows. In order to prevent any impact, the deflection movement of the needle foot is further magnified because the spindle 9*c* of the deflector 9 is supported in rubber or respectively in a plastics which remains soft. With sharp needle feet the separation by the needle deflector even with a small distance between the tips 2*c* of the feet is absolutely certain and an impact excluded. Tests were however also made with round needle feet which produced very good results with a resiliantly supported deflector, and no impacts of the needles occurred, since the polished edge of the apex at the point of contract of the needle foot starts to slide against its roundness or springs away over the roundness. For the sake of simplicity in the further figures only the outline is indicated.

Figure 9:
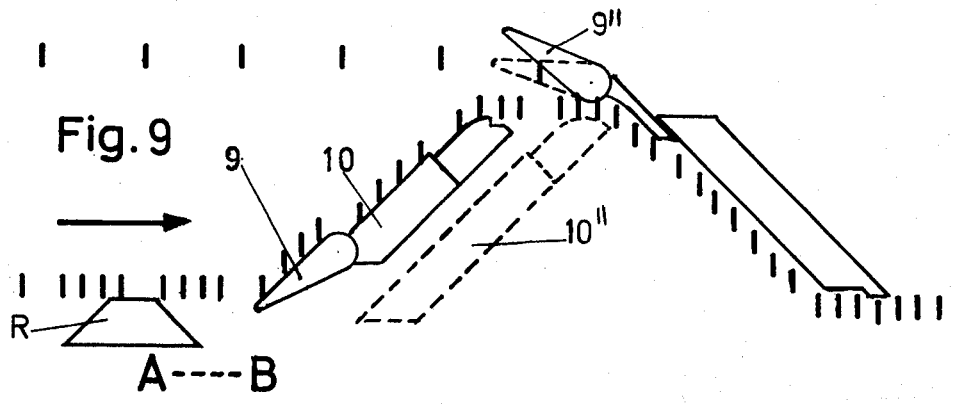
FIGS. 7, 8 and 9 are respectively schematic illustrations of different needle paths with different settings of the needle-deflector.

By the deflector 9 there is achieved at the entrance to the cam a simple changeover to knitting, of only selected needles. The deflector can also be set at other points where it is of value to pass the path of the needles without risk through a narrow space, i.e., without impact, as is shown, e.g., by FIGS. 7 to 9. There a lifting cam for circular knitting machines is shown, in which besides the deflector 9′ for the selector system there is provided a deflector 9″ having, three positions in the upper central portion, as well as a second lifter 10″ with a tuck portion.

Figure 8:
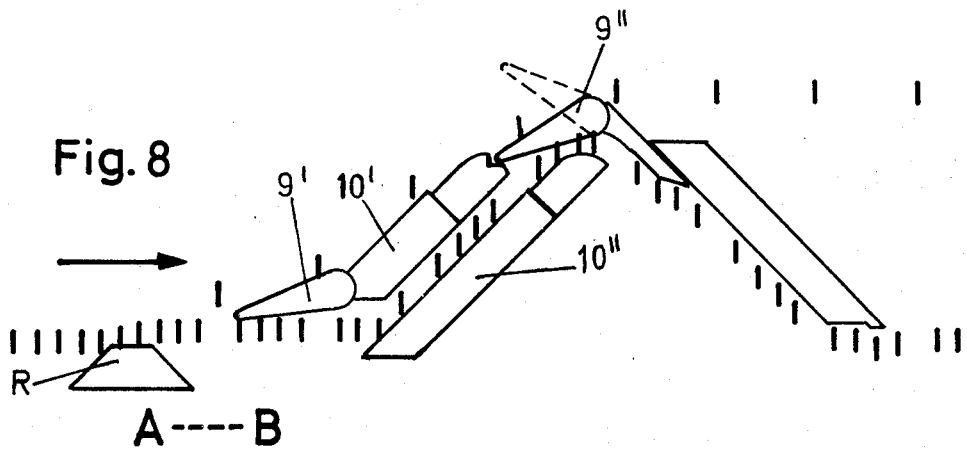

By the deflector 9″, see FIG. 8, the selected needles (in this example every fifth needle) can be guided via the cam out into a standby position in which during knitting on all the other needles these loops are held back one or more times so that they produce an openwork pattern with agglomerations. By a like deflector 9″ of a subsequent cam these needles can by elevating the deflector as shown in FIG. 9 be brought back again, and this can take place during the normal knitting process on the other needles.

Figure 7:
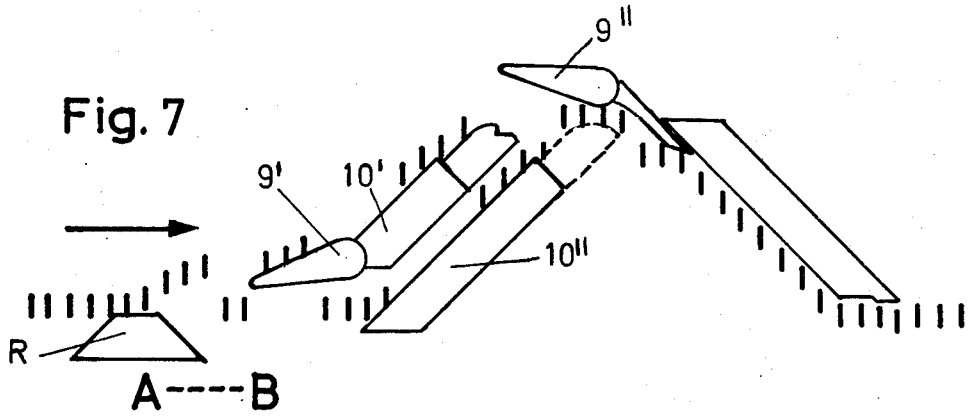

FIG. 7 shows another example in which the needle deflector 9′ guides the needles preselected over the stage A to B over the complete knocking-over position, while the remainder of the needles are brought by the switched-in second lifter only into the tuck position. In this way, thanks to the deflector 9′ and the second lifter 10″, two kinds of loops can be knitted in one cam process.

For those skilled in the art it is easily understandable that, by means of the selector mechanism and deflector, other patterns may also be formed such, e.g., as jacquard knitting with floating yarn, so that further illustrations are superfluous.

Figure 12:
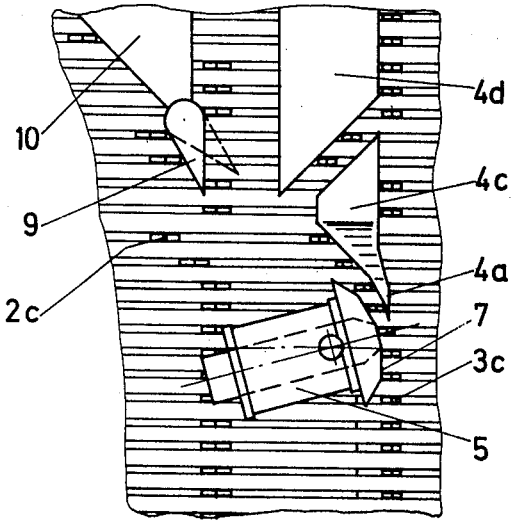
FIG. 12 is a plan of FIG. 10 showing the needle-bed without the cam plate.

For all control units moving to and fro, it is provided that the electromagnet 5 have, axially to its magnet cores lying one above the other, a fulcrum about which the magnet pivots when the cam changes its direction of motion (see FIG. 12). This fulcrum must correspond with the needle pitch and, remembering the required oblique position, be on the centreline more or less close to the ends of the poles. For a slightly oblique position of the pole ends 5*a* and 5*b* the fulcrum must be further away from the ends of the poles and for a strongly oblique position nearer to them. The start of the edge of the poles of the magnet is to be determined by the start of the needle pitch, if the scanner mechanism lies on the boundary of the control field. The angular freedom of the magnet must be so limited that it swings out of the centre line to both sides by the actual width of the pole. The pivoting is automatically carried out at the change of direction of the cam, as soon as one magnetic pulse occurs.

Figure 11:
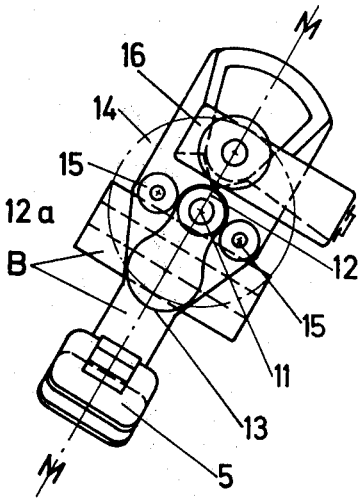
FIG. 11 is a plan of FIG. 10 seen in the direction of the arrow III showing the block B.

In addition, as shown in FIG. 11, it may be provided that the control unit is united with the selector magnet 5 into a block B so that the centreline of the fulcrum of the magnet 5 coincides with the centreline of the scanning member 16, or that the actual starting edge of the pivoted magnet pole coincides on a line with a boundary between two control fields as well as with a boundary of the needle pitch.

These measures make it possible that any pattern with any width of repeat can be knitted repeatedly or else singly, since the same boundaries of the control-fields are wound off always exactly with the same boundaries of the needle pitch, since the gearwheel 14 remains continuously in engagement with the rack 14*b*. At the repetition of one width of repeat the control member in its endless form needs to exhibit in one row only as many control-fields as the pattern requires needles. In the case of a design which in a piece of knitting only occurs once in its width, the control member must exhibit the same number of control-fields as the piece of knitting requires needles.

This combination of control member and selector mechanism can also find employment in the selection of other members such, e.g., as for the sinkers of purl stitch machines or hosiery machines.

In the case of multicam machines one such selector unit is provided for each can. For the sake of simplicity all are connected solidly with one rod which oscillates over the length of a single cam.

The block B is coupled with the carriage in such a way that it moves ahead of the entrance to the cam or of the needle deflector 9 respectively so far (see FIG. 12) that the selected needles arrive in their final position before the deflector. At the end of the row of needles the drive is released by means of a trigger wedge and the selector unit is thereby held stationary while the cam carriage runs on until the cam is clear of the needle field. On the return of the carriage the unit is taken along with it again, that is, moves again ahead of the entrance to the cam or of the needle deflector 9 as shown in FIG. 12.

Two stops or strickers respectively (not shown) must be fixed accurately so that at the start of the striker the scanning member 16 lies on the boundary of two control fields, while the leading pole-edge lies on the boundary of a needle pitch.

It is shown by FIGS. 1 and 12 that the magnet 5 is reinforced round its projecting pole-ends 5*a* and 5*b* with an antimagnetic material 5*c* both sides of which are ground off obliquely so that when in the lead in the pivoted outwards position of the magnet they provide a straight guide for the selector member and also reduce the wear on the pole edge 5*a*.

FIG. 10 shows in section a needle bed of a hand-operated knitting frame on which certain needles for the purpose of narrowing or grouping can be pushed down out of operation.

In the case of this embodiment a control member 13 is provided, the surface of which is provided with a highly conductive metal coating. Here too the boundaries of the control-fields coincide with the boundaries of the needle pitch. The weak control-pulses are in this case picked up directly by a fine sensor-wire, the conductive surface being made live and the negative control-fields by printing with insulating varnish being made non-conducting. Here too the control-fields are arranged one above the other in endless rows and the scanner after each movement of the cam can be brought by a threaded spindle onto another row of control-fields. These features of the control, however, do not form part of the present invention and are presented here only for purposes of explanation.

In FIG. 10 it can be seen that the teeth 14*a* of the driving gear 14 mesh with a stamped toothed belt 14*b* instead of with a rack. For secure engagement of the teeth a supporting member 14*c* is provided on the block B, which keeps the belt 14*b* always in engagement.

FIG. 11 shows a front elevation of the block B seen in the direction of the arrow III seen in FIG. 10. The factor of the always stationary centreline M with the travelling to and fro of the interlocked unit (control member and preselector magnet) is thereby illustrated.

By means of this arrangement, it is provided that at each change of direction of the cam the edge of the pole which lies nearer to the members 3 moves to a position on the centreline M and thus serves as the starting point of the magnetic pulse, at any point at which the block 3 lies. There is thus provided synchronization of the four points, namely: the scanning point with the control-field boundary, and the starting-point of the magnet pole with the boundary of the needle pitch.

In FIG. 10 there is provided a recess 1*c* extending longitudinally through the profile of the needle bed 1, with a round channel 1*d* connected therewith. The recess 1*c* extends slightly higher than the bottom of the needle tracks so that at this point upon milling the tracks they become continuous. The members 3 have a round head 3*a* which fits exactly in the channel 1*d*, and thus the members can be inserted from above through the tracks into the semicircular channel 1*d*. For shutting off this channel 1*d* short profiled segments 1*e* of plastics are provided, which complete the circular guide of the member 3 and secures the latter against involuntary removal. For the purpose of good lateral guidance of the member 3 these segments 1*e* have spacer-teeth 1*f* which have the same pitch as the webs of the needle bed. These segments can be clamped on resiliently so that exchange of the members 3 is easily possible.

In order to secure the separation of the members 3 between the normal position A and the out-of-operation position D, over the whole length of the needle bed plastics segments 17 are provided, which have transverse slot 17*a* at the same pitch as the needle bed, through which the members 3 can be pivoted from one position into the other. The webs formed by the slots, however, have behind the two end-positions bulges 17*b* creating constrictions in order to prevent involuntary passage therethrough of the members 3, but also at the same time to enable intentional passage therethrough, the segments being injection-moulded from a plastics which has good elastic qualities such, e.g., as acetal resin.

Figure 13:
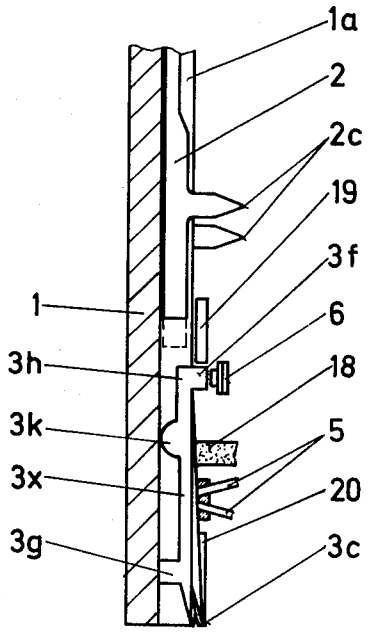
FIGS. 13 and 14 are respectively sectional and plan views of a further example of preselection by means of selector members arranged in a needle track.
Figure 14:
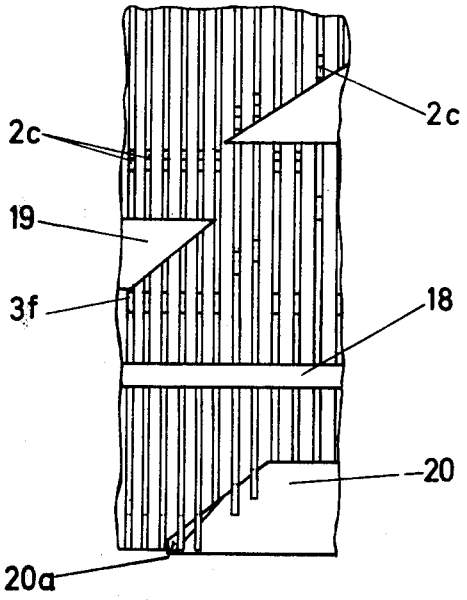

The advantageous features of this arrangement, i.e. the member 3 oscillating about a fulcrum, the magnification of the preselection movement by the length of the shank 3*b* and the tips of the members for good separation, can also serve in other layouts of the members 3 such, e.g., as shown in FIGS. 13 and 14.

In FIG. 13 the members are guided as small rockers 3 directly behind the needles 2. Each member has as a fulcrum a round head 3*k* which is forced against the bottom of the track by a soft rubber strip 18 or a lightly elastic spring-member. Behind this head 3*k* a foot 3*f* on a small lever-portion is provided, which projects a slightly from the needle tracks. This foot serves on the one hand for the action of the preselector elements 6, in this case piezoelectric as described by FIG. 2, and on the other hand for the alignment of the member by means of a straightener wedge 19 on the lifting cam.

On the opposite side of the member a narrow shank 3*x* is provided which magnifies the deflection of the actuator up to the tip 3*c*. The outside of this shank is provided with a one-sided tip 3*c* which in its normal position is below the plane of the needle bed. Connected with the tip 3*c* on the inside thereof is a guide-piece 3*g* projecting into the needle track and serving for longitudinal desplacement of the member. This guidepiece is so deep that in the raised position of the tip 3c it still serves as a lateral guide in the track. Adjacent the top of the needle bed a thin wedge 20 is provided, which has a separator-tip 20a chamfered off downwardly (see also FIG. 14).

In the case of a selective deflection of the member 3 its tip 3c projects above the needle bed and the separator tip 20a of the wedge 20 engages from the outside obliquely under the tip of the selected member and raises it. Then a sliding movement is imparted by the wedge 20 to the guidepiece 3g in order to slide the members 3 further towards the respective needle 2 and bring the latter into operation. Here too the selector elements 5 and 6 need for the preselection only an insignificant force in order to effect the deflection of the tip. All the other movements are effected by the thrust of the cam. The poles of a selector magnet are indicated again by 5. In FIG. 14 a plan of the needle bed is shown, on which the positions of the wedges 19 and 20 can be seen.

Due to the possibility in the case of multiple cams on a straight bar machine of so controlling all the needles in front of each cam that they operate or not, the costly constructions of three-track cams are no longer necessary. There is still need for only one row of cams which in turn receive merely the necessary settings for Jacquard truck position and standby position. Naturally in the case of multisystem cams a separate needle selector mechanism is associated with each system and one such also with the cams for loop transfer.

The features described below will allow the most important factors of the needle selector mechanism above described to be achieved:

1. In order, in the use of cheaper straight bar knitting machines, to avoid the pivoting movement of the electromagnet, the pole surfaces are chamfered upwards from the centre symmetrically in both directions of working at about 15° to 30° so that in either case the trailing pole surfaces lift the selector members as the magnet poles pass thereby.
2. In order during lifting of the selector members to strengthen the adhesion to the pole edges leading obliquely upwards, the back of the selector member is cut in a slightly widened bead with a convex surface of the bead so that at the forward circumference of the tip a shart selector edge is formed.
3. In order to prevent any impact of the selector tip against the sliding parts, the lower tips of the sliding parts are made longer than the selector tips, and in order to require only a very short movement of the selector tips, the edges of the sliding parts over the points at which the tips of the selector members pass are ground knife-sharp and polished.
4. The airgap between the pole surfaces of the electromagnet and the backs of the selector members can due to unavoidable tolerances in the guides for the selector members and in the guidance of the auxiliary carriage, have a disturbing effect. This circumstance can be eliminated by the fact that in front of the electromagnet a lifting wedge is provided, which engages under the tips of the selector members and brings them forward with their backs closely against the magnet poles so that only a small airgap remains. By this means certain and rapid attraction of the selector member to be selected is enabled when there is a magnetic pulse. The single tolerance necessary now lies only in the thickness of the tip, which can be made very small.
5. Instead of previous control principles, in this embodiment the principle of transillumination through the control member onto a photoelectric cell (phototransistor, photodiode) is employed, the latter converting the incidence of light electronically into control signals or magnetic pulses respectively. As the control member there is provided an endless belt provided with guide means and of transparent material such, e.g., as high-pressure polyethylene, acrylic or acetate upon which, in accordance with a pattern, negative control fields are formed in rows as opaque fields. Reading of the pattern is effected in rows because outside the belt a scanning head adjustable in rows is arranged, having a photodiode or a phototransistor with a mask respectively, while inside the belt a light source is provided, which is equipped with a reflector concentrating the beam of light onto a point, and is connected with the scanning heat by a stirrup, and hence just as the scanning head is switched from control row to control row, whereby the photoelectric cell or the mask opening respectively and the light source always face one another accurately.
6. In order to keep the displacement of the selector member as short as possible and also to exclude the selector member from a selective movement in the event of a needle being pushed out of operation, a recess is provided below the needle track with a surface extending to the bottom of the track, and the selector member has a shank the end of which is bent down from a slightly raised point so that in its normal position it lies in the recess below the bottom of the needle track. If a selector member is intended to displace the associated needle, the end of the selector member first of all slides a short distance upwards on the oblique surface and hits the needle into the pattern position. The selector member is immediately pulled back again into its normal position by a return-wedge. If, however, a needle is pushed out of operation the butt of the needle slides over the operating end of the selector member onto its raised point at which the latter is clamped by elastic stressing of the shank. The selector member is thereby held down firmly, so that the field of force of the magnet is not adequate to raise the member. Due to this measure, besides ensuring that a not needed selector member is maintained out of operation, a significant shortening of its path of operation is effected. For easy rising of the shank, the oblique surface of the recess is lined with a smooth strip of sheet steel which can be magnetized in order to keep the end of the shank in its normal position.
7. In order to have the possibility of being able to knit in one colour pattern or loop pattern without repetition at a certain point in the piece of knitting, slidable uncoupling means are provided which can be set on the boundaries of the corresponding repeat. It is thereby achieved that only over this stage does needle selection take place. The remaining needles which are to knit the ground colour are in that case brought into operation by special lifters. It is likewise provided that the electrical circuit of the control is also interrupted by these uncoupling means.

Figures 15, 16, 17, 18, 19, 20:
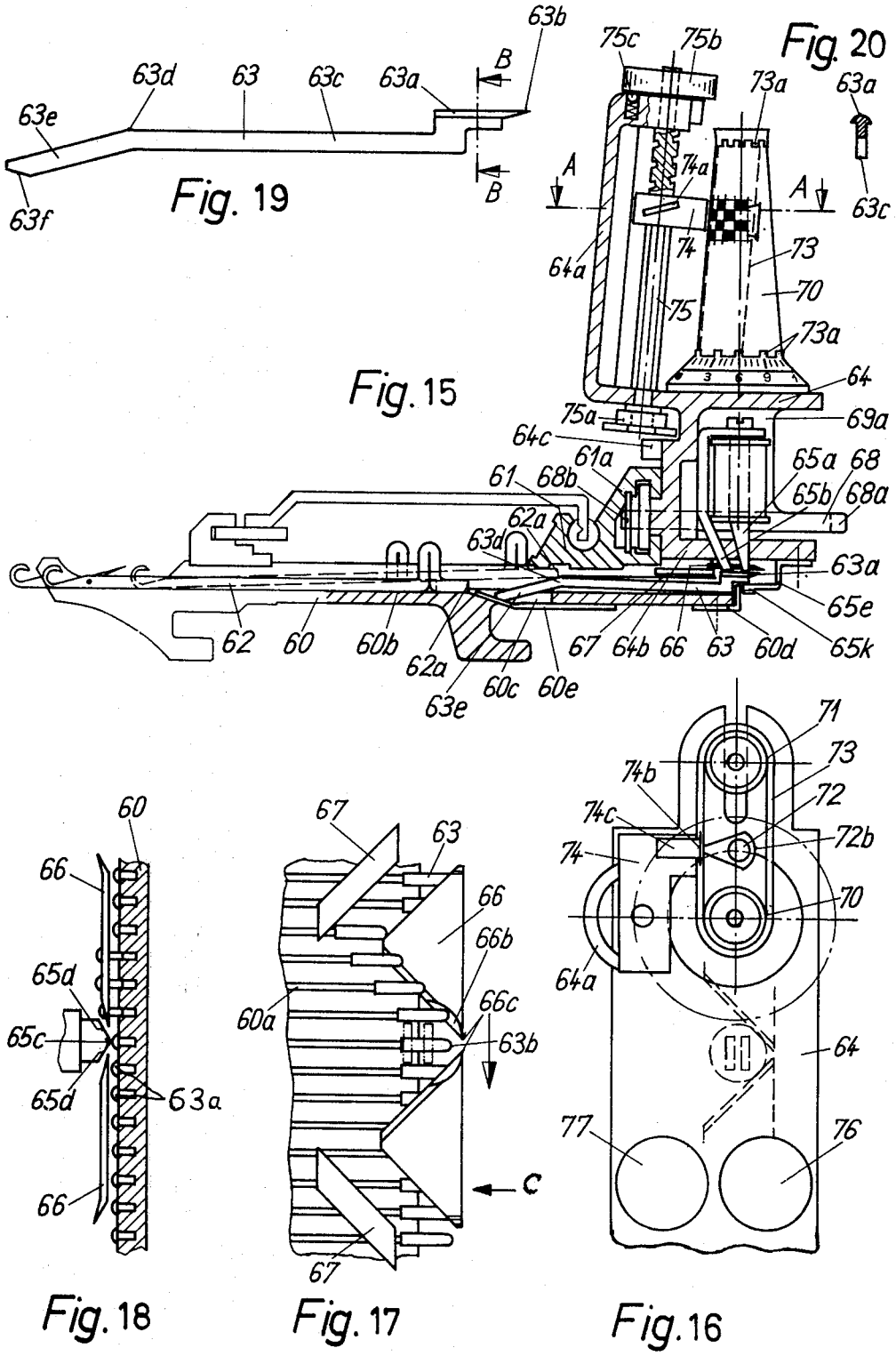
FIG. 15 is a section through a needle-bed and transversely through an auxiliary carriage showing a photoelectric scanner head and a control member.
FIG. 16 is a section along the line A—A in FIG. 15 through the scanner mechanism.
FIG. 17 is a plan of the auxiliary bed of the selector member.
FIG. 18 is a partial section taken in the direction C of FIG. 17.
FIG. 19 is an enlarged view of the selector member.
FIG. 20 is a section through the head of a selector member along the line B-B in FIG. 19.

FIG. 15 shows an embodiment for hand-operated knitting machines in which the control unit is arranged combined in one line with the selector mechanism on an auxiliary carriage which by a coupling mechanism can always be coupled in advance of the entrance to the cam.

The poles 65*a* and 65*b* of the electromagnet 65, see FIG. 18, are in this embodiment stationary. From their lowest central point outwards to each side they have a symmetrical surface 65*d* leading obliquely upwards. The control pulses which, due to the special control member, are respectively maintained across a whole needle pitch start respectively when during the running of the control member the central point lies exactly over the head 63*a* on the selector member 63, which forms the armature. The head of the selector member is thereupon attracted by the magnet poles and trailed along the surface 65*d* leading obliquely upwards. This produces during the movement of the carriage a lifting movement of the selector tip 63*b* so that the latter arrives over the edge of the succeeding sliding part 66 and is driven thereby towards the needle butt 62*a* in order to slide the corresponding needle into the pattern position. The head 63*a* of the selector member 63 is provided with a convex bead which has the purpose of enlarging the cross-section so that the field of force of the two poles 65*a* and 65*b* will be more effective. The doming is provided in order to obtain while it is being pulled up along the oblique surface 65*d* a favourable angular ratio of the lines of force to the bead. This measure has produced a considerable improvement with respect to the previously applied selector members.

In order to keep the selecting movement of the selector tips 63*b* upwards as small as possible the sliding parts 66 at the points at which the selector tips pass thereover are provided with a polished section 66*b*. The edge is at this point knife-sharp, so that the selector tips only have to be raised slightly to be selected for operation. This polished section also prevents any abrupt impact since the selector tip 63*b* is also sharp and polished.

Those selector members which receive no magnetic pulse remain down as is shown in FIG. 18 by the three uppermost selector members therein. The members do not slide their associated neeldes into the pattern position.

A further important improvement has been achieved because in front of the electromagnet a lifter 65*e* is provided which engages with its stationary raising wedge 65*k* under the head of the selector member in order to bring up the head 63*a* thereof as close as possible to the pole ends 65*a* and 65*b*. Differences in air gap which have resulted from unavoidable tolerances between the needle bed and the guide rails could thereby be eliminated. This measure confers a significantly better security of selection, since the air gap between the armature surfaces of the heads 63*a* of the selector members and the magnet poles can be reduced uniformly and almost to zero with all the selector members.

Instead of the use of previous control principles, in the case of this embodiment there is used the principle of transillumination through the control member onto a light-sensitive cell such as, e.g., (phototransistors, photodiodes), the latter converting the incidence of light electronically into control signals or magnetic pulses respectively. As the control member a transparent endless belt is provided, to which are applied opaque control-fields.

Inside the endless belt between guide rollers 70 and 71 is provided a light-source which is connected by a stirrup (not shown) with the scanning head 74 so that the small light-source takes part in the adjustment of the scanning head and thus always lies exactly opposite the small opening in the mask 74*b* in front of the photoelectric cell. Each row of the endless belt is divided, to correspond with the pattern of a row of loops, into transparent and opaque control-fields the boundaries of which during the unwinding agree exactly with the boundaries of the needle pitch. Those control-fields which are to produce a magnetic pulse remain transparent, while the negative control-fields are provided with an opaque coating. This coating can be produced by hand by the method of screen printing or photochemically. It is specially contemplated that a transparent belt is employed onto which are applied opaque control-fields.

It is a further navel feature of the invention that the endless belt may be injection-moulded in a conical shape together with its set of teeth from a soft plastics such, e.g., as high-pressure polyethylene. Large belts for industrial machines can consist of acetate belting which is provided as a strip of film with feed or guide holes respectively, and after application of the opaque control-fields by coating, are glued into an endless cylinder.

In FIG. 15 yet another particularly interesting measure for securing the out-of-operation position of needle and selector member is illustrated, which is especially necessary with knitting machines in which not all needles come into operation or in which removal from operation of some needles is normally done by hand. For this purpose a recess 60*c* is provided in the bottom of the needle track, which during milling of the needle tracks results in an opening downwards from the tracks. The shank of the selector member 63 has a downwards bend 63*e* and a bevel and 63*f* (see also the enlargement in FIG. 19).

In its normal position the bevel end 63*f* lies below the bottom of the track so that upon sliding of a needle 62 down the track, needle end 62*a* rides over the end 63*f* of the selector member and clamps itself under the guide rail 61, while the selector member is thus forced down so firmly that it cannot be raised by the electromagnet 65.

Besides this favourable securing of the retention out of action of needles 62 not needed, as well as the respective selector members 63, there is achieved by means of the overlapping another significant shortening of the working path of the selector member, thereby requiring a considerably shorter needle bed. In the case of needle beds of aluminium it is further provided that the oblique surface of the recess 60*c* is lined with a piece of sheet steel which is magnetized. The ends of the selector members are thereby held down in their normal position. They are for this purpose provided with the bevel end 63*f* whereby a high force of adhesion is achieved.

In order to create the possibility of forming one colour pattern or loop pattern without repetition at a required point in the piece of knitting, adjustable means are provided on both sides of the auxiliary carriage 64, and act like known pick-up setters of the yarn carrier boundaries and thus will not be described in greater detail. It is however contemplated that the new pattern principle described above (auxiliary carriage on which control members and selector members cooperate by unwinding at the appropriate pitch) is limited in its run by coupling and uncoupling means in order to be able to form the pattern once only, as in a monogram, or a required number of times.

There are likewise provided in the auxiliary carriage 64 at both sides of the driving dogs 64*c*, means for switching in and out the operating current for the control and selection mechanism, which at uncoupling switches off and at coupling switches on (not shown). The current source is thereby automatically economized, which particularly with battery feed is important.

FIG. 15 shows, as already mentioned, an embodiment of a needle selection mechanism for domestic knitting machines. Besides the bottom carriage guide 61 a further separate guide 61*a* is provided for the auxiliary carriage 64. On this small auxiliary carriage the drive for the control member 73 as well as the whole of the mechanical, electrical and electronic parts are built. The whole of the parts of the control and the electromagnetic selector mechanism are thus so united that a discrepancy in timing in the emission of signals can never occur. This auxiliary carriage can precede the main cam and be coupled and uncoupled automatically for the pattern. When not needed it can without inconvenience remain stationary on the guide rail 61.

The drive of the control member is effected during the displacement of the carriage 64 by the gearwheel 68 which engages by its teeth 68*a* in the stationary rack 68*b* accommodated in the guide groove 61*a*. The shaft of this gearwheel is supported in the hub 69*a* and carries above the carriage 64 the feeder cone 70 for the different control members 73.

The knifepoint selection principle with the pulling up of the selector tips by the obliquely set pole faces which extend only over one needle pitch, and all the other favourable measures which in the preceding text have been described move for hand-operated knitting machines are also usable for industrial knitting machines.

With cylindrical machines the selector system always precedes the cam and each cam has its own control system the selector systems of which are turned for only one direction of movement. Naturally the selector systems can also be controlled by other stored means such, e.g., as computer storage.

One of the most important features of the described mechanism is that the selector member racks about a fulcrum, and at the outside comes to a point in order with a very small deflection during the movement of the cam to be preselected by a sharp separator-edge. It thereby becomes possible to effect the small selective movement with a minimum of electrical power which can be controlled electronically by, for example, obliquely set magnet-poles, piezoelectric moving-elements, bender-elements, plunger-coils or oscillating-coils.

Next, a further embodiment of the described tip-separator edge principle of the invention will be explained with reference to FIGS. 21–25. Instead of a fixed pushrod-foot there is provided a member supported in the pushrod to be able to rock within limits and with a tip pointing upwards. Here too preselection can take place with a small deflection by a small electrical power, because the tip of the rocking member is moved behind a separator-edge passing by with the cam and lying obliquely, in order to be engaged by such separator-edge more and more deeply so that thus selected pushrods are driven by the succeeding driving wedge towards respective needles which are to be moved into the operating position.

By FIG. 21 yet another embodiment of the "tip-separator edge" selection principle is illustrated.

In FIG. 21, slightly enlarged, is shown a portion of a pushrod 81 with a rocking member 82 as the selector member. This rocking member 82 has at the bottom a head 82*a* with flat sides and a rounded edge, which is quided in a recess 81*a* in the pushrod 81 to be able to oscillate therein. When both parts are inserted in the needle track 80*a*, see FIG. 23, rocking member 82 will be guided therein. The round bottomed recess in the pushrod has sides diverging upwardly and outwardly, so that stop-edges 81*b* are formed, which limit the deflection of the rocking member 82 to each side to about 5 degrees (see FIG. 21).

The rocking member 82 is so thick in its bottom portion that it has just enough play for movement in the guide needle track, but the portion of member 82 extending without the needle track can be thicker so that the field of force of the two poles can act more strongly. It is likewise foreseen that the edges running down from the tip 82*b* to the thinner part are slightly rounded by stamping so that an easier run along the deflector edge is achieved. The two edges are inclined at an angle of about 5°, so that in the swung-out position the opposite edge extends perpendicular to the pushrod bed, and so that the ejector wedge of the deflector 83 and of the return-piece 84 can have an angular working surface.

In FIG. 22 are shown the two extreme positions of the rocking member 82 in cooperation with the oblique separator-edge 83. The deflection from the perpendicular centreline amounts on both sides to about 5°. In the position swung to the left the rocking members 82 are in their mormal position. This normal position is maintained up to the selector gap.

At that point those rocking members which are to slide their associated needles into the operating position are moved forwards by an electronically controlled electrical force so that their tips 82*b* move to a position behind the thin separator edge 83*a*. By this knifelike edge the preselection of the rocking member is first of all secured, and the pushrod 81 is now driven forwards by the wedge surface 83*b* which falls obliquely downwards and also leads obliquely forwards, in order then to be moved towards the associated needle. Between the end of the pushrod and the butt of the needle a gap of a few millimeters is provided in the normal position, so that the resistance of the sliding of the needle only occurs in the course of the movement of the pushrod. The rocking member 82 is also so conceived that only an extremely small expenditure of power is necessary for swinging the tip 82*b* into its preselected position. This small movement can be effected from behind either by a piezoceramic movement-element 87 or by the moving coils (as described earlier, but not here shown).

This movement can also be effected from the front by the obliquely set poles of an electromagnet 85 as shown in FIGS. 26 and 27.

The process of selection is, in the case of an embodiment with electromagnetic selective movement, the following:

The control signals arriving from a control member in which during the running of the machine the boundaries of the control-fields coincide synchronously with the boundaries of the needle pitch, are amplified and transmitted to the electromagnet 85, the poles of which are set obliquely to the line of travel of the rocking members sliding past in their mormal position, and the nearer edge of the magnet poles touches the rocking members firmly. With a current pulse, which in this case lasts from one boundary of the needle pitch to the other, the rocking member 82 is attracted along the obliquely set edge of the poles. The tip 82*b* of the rocking member thereby makes a movement forwards so that its tip moves behind the separator edge 83*a* passing by at the same instant. At this moment the preselection is already secured and the further movement of the pushrod follows mechanically by wedge action. The needle is thereby moved behind the peak edge of the needle deflector 9 which quides it by means of the clearing cam 10 into the required knitting process. The process is repeated consecutively from needle to needle. Those needles the pushrods of which have not been influenced are in the same manner brought to knitting by another cam or, upon a return movement, by the same cam. With straight bar machines with needle cams moving to and fro, the electromagnet 85 has a fulcurm 85*d* about which it can swing with a change of direction of the carriage, so that the other electromagnet edge is moved to the desired centreline.

For better explanation of the process of selection the needles taking part in the selection process are numbered in FIG. 27. The cam moves in the direction of the arrow P. In that case the rocking member No. 1 lies directly on the control boundary in front of the magnet poles, and if the magnet receive a pulse member No. 1 is attracted and trailed along the oblique edge of the poles and thereby moved forwards so that its tip is behind the obliquely falling separator edge 83*a*, as illustrated by the position of member No. 2. Members No. 3 and No. 4 are already being moved by the lower portion of the separator edge having a shallow wedge shape in the direction of the respective needles, while members No. 5 and No. 6 are being driven at their bottom portions by the steeper wedge shape towards the respective needles. Member No. 7 is in the highest position, and hence its associated needle has arrived above the tip of the needle deflector 9 from which it then reaches the knitting process via the lifter 10, as illustrated by the needles of members No. 9, No. 10 and No. 11, the pushrods of which are being returned by the return wedge 84 into their normal position. Member No. 8 was not preselected and thus remains in its normal position. In order to be able to preserve for the selection process an accurate normal position of the rocking members 82 a straightener wedge 88 is positioned adjacent and preceding selector cam 83, see FIG. 26, which guides the pushrods together with the rocking members towards the straightener face 83*b*.

As already mentioned, this selection principle can be applied both to flat and also to cylindrical knitting machines, but it can also find application in the case of hosiery machines or other loop-forming members.

In the case of the embodiment as FIGS. 1 to 14 a main feature is that the differently arranged selector members have a selector tip with a separator member in order to achieve with a short travel and a small expenditure of power a high frequency of selection. As means of movement obliquely set poles of an electromagnet and piezoceramic elements were proposed, while on the other hand moving coils in plunger permanent magnets are empolyable as means of movement. These members are moreover applied in the field of loudspeaker technique, where by means of modulated current, pulses cause a diaphragm to oscillate at different amplitudes in order to be able to reproduce high and low notes. That these moving coils reach high frequencies is due to their low inherent weight and the maximum of switching speeds.

Thus, there is provided a movement-element with only a moving coil and a plunger magnet, in which the coil is so wound that it is brought into operation by a positive current pulse and pulled out of operation by a negative current pulse. Due, to the new control members with transparent and opaque control-fields, and due to the scanning mechanism by means of a lightbeam from one side and a light-sensitive element from the other, positive and negative singals in accordance with the pattern can easily by generated, which when amplified electronically are transmitted to such a moving coil. This kind of switching or control respectively permits the highest frequency of movement of the coil.

The coil has at the end facing the selector member a wedge which with the forward movement of the coil penetrates into the gap between two selector members and remains there until at least the next selector member passing by is drive by the wedge into its preselected position.

Most of the patterns to be formed, be they reliefs, plains or plated Jacquard patterns, are formed of groups of a number of loops, so that the coil during a whole group of positive control fields remains in the operating position or in the case of negative current pulses remains in the out-of-operation position respectively. In its operating position the operating-wedge of the coil slides one selector member after another into its preselected position without the coil having to move to and fro. For this reason the positive control fields arranged one after the other are only defined by very thin boundary lines which can produce no interruptive switching in the photo-element. The negative control-fields also maintain the signal until the boundary of the last field of a group. This positive-negative switching offers correspondingly great advantages because the coil thus does not have to switch for each needle.

At the same time improvements are provided in the execution and arrangement of the selector members as well as the separator means. Thus in one embodiment a selector member is provided, which is suspended on a wire on the bottom of its guide-track, and in this way with very small consumption or inflow of power can execute a rocking movement, a movement which brings its selector tip into the preselected position from which the selector member is moved mechanically towards the associated needle. The selector member has underneath a fulcrum thereof a foot with a selector tip and above it a foot for the purpose of action by the operating wedge of the moving coil.

In a second embodiment there are, for the purpose of displacement, provided underneath a pushrod with a special foot selector members lying transversely with special selector tips in the form of oscillating rockers which can be brought by the operating wedge of the moving coil into the preselected position. For the purpose of separation and movement towards the pushrod, a separator-roller with a wedgelike rim is provided. This separator-roller engages momentarily by means of its sharp edge behind the tip of the selector member arriving in the preselected position in order to secure it in this position and then to force it towards the pushrod until the latter arrives with its foot behind the tip of an ejector-piece and is driven by this ejector-piece towards the associated needle.

The selective movement is effected by the operating wedge of a moving coil.

With the aid of FIGS. 28 to 31*a* the basic idea of this embodiment of the invention will be described in greater detail.

FIG. 28 shows a selector member 30 in a vertical arrangement directly under the butt of a cylinder needle 2. In the centre the member is suspended on a wire 30*d* to rock thereabout, and is guided freely without pressure by an annular spring 16. The member 30 has two feet 30*a* and 30*b* projecting above the needle bed. The foot 30*a* carries a selector tip 30*c* which is moved outwardly by light pressure on the foot 30*b*. Close above foot 30*a*, on the stationary cam, a slide-piece 31 is arranged, see also FIG. 28*a*. Against the direction of movement of the needle cylinder 1 this slide-piece 31 has an oblique chamfer 31*c* which at the bottom tapers almost to a point. If the tip 30*c* is moved slightly outwardly it runs onto this chamfer 31*c* and the selector member is moved by the oblique edge towards it associated needle.

As the means of control and movement a moving coil 37 with a plunger magnet 34, 35 is provided in the cam above and aligned with the row of feet 30*b* and tapers conically down to a guide tube 37*c*, which is guided in a bush 37*d*and which mounts a wedge 38. At the cylindrical end the coil is guided round a pole plate 36, on two guide ribs 36*a*, see also FIG. 29. The permanent magnet 35 points axially so that the winding of the coil 37*a* is supported in a round slot between north and south poles. The winding of the coil 37*a* is so wound that, with a positive current pulse, the coil makes an outwards stroke. For limiting the movement, stopes 37*e* are provided. There may be ribs on the inside of the cone which abut against the pole plate 36.

Due to the special type of control by the control-fields, which as already mentioned maintain the control signal from one boundary to another, the weak force of the thrust of the coil, does not itself move the selector members, but the movement of the coil is so controlled in time that the wedge 38 moves into the gap between two selector members, i.e. in front of the selector member to be moved. It is therefore the surface of the wedge 38 which moves the selector member inwards as it moves thereby. Normally a number of selector members can or have to be moved one after another.

The selection process will be explained with reference to FIG. 28*a*. The needle cylinder in this case moves towards the right. The whole of the parts of the cam and the selector mechanisms are accommodated in the stationary cam casing. The moving coil and the wedge 38 respectively are here arranged on the line M. The wedge 38 when pulled back does not touch the feet 30*b* of the selector members until it receives a positive signal. By this signal it is moved into the gap in front of the foot 30*b* to be moved. The wedge 38 then presses this foot slightly inwards so the selector tip 30*c* rises above the thin edge 31*c* of the slide-piece 31. The selector member is moved by the oblique edge 31*b* towards its associated needle 2 until the tip 2*c* of its foot 2*a* arrives behind the peak edge 9*a* of the needle deflector 9, whence the needle is guided into the knitting process. At the highest point reached the foot 30*a* is brought back by a return-piece 31*a* into its normal position again. In FIG. 28*a* it is shown how even-numbered needles are brought into operation. Selector member No. 14 is just receiving the pressure of movement from the wedge 38 and the selector tip is arriving just over the separator edge 31*b*. As soon as the selector tip has moved only slightly over this edge the selection process becomes secured.

In FIGS. 30 and 31 another arrangement of selector members with the aid of pushrods is shown. Below the needle cylinder 1 a ring 40 is provided with channels 40*a* milled in its face. In these guidechannels, which form a continuation of the needle tracks, rockerlike selector members 32 are guided on an annular spring 1*b* to be able to oscillate. These selector members have a guidinghead 32*a*, a shank 32*b*, a selector tip 32*c* and a foot. They have a normal position A, a preselected position B and a final position C. Their normal position A is formed by a stop-wire 40*d*. The moving coil is arranged below the row of feet, being indicated here only by the wedge 38. Between the needles and these selector members there is provided one pushrod 3 each, with a foot 3*a*. Above the tips 32*c* a separator roller 33 is provided for each system, and has an almost sharp separator edge 33*c* which tapers to a wedgelike rim. The separator edge 33*c* engages immediately behind the tip 32*c* of a selector member arriving in the preselected position B and forces the tip little by little towards the pushrod 3, into position C. In this position the tip of the foot 3*a* of the pushrod is moved behind a peak edge of an ejector-piece 31 which drives the pushrod towards the needle (see FIG. 30). In this case return-pieces 31*a* are likewise provided for returning the pushrods and the selector members. For the purpose of simple review, in FIG. 31 the even-numbered needles, pushrods and selector members are moved into the operating process, and selector member No. 14 is shown as just being brought into the preselected position. In FIG. 31*a* it is shown again how the tip of the selector member No. 14 has just arrived behind the separator-edge 33*c*. The feet 3*a* of the pushrods 3 are likewise provided with tips and the ejector-piece 31 with an obliquely sloping peak edge. These features serve for secure separation with only a short path of adjustment. Their special features are known and are thus not explained here in greater detail.

These new elements have been described for circular knitting machines but are also usable with straight bar knitting machines.

I claim:

1. A needle selection mechanism for use in cylinder and straight bar knitting machines of the type including a member having a plurality of needle tracks each containing a needle movable from a non-knitting position to a knitting position, said mechanism comprising:

a control member having thereon control-fields the boundaries of which coincide with the boundaries of the pitch between said needles, a portion of said control-fields representing selected needles;

means for scanning said control-fields and generating control pulses representative of the dimension thereof and of at least one whole needle pitch, corresponding to said selected needles;

each of said needles having associated therewith a selector member including a pointed tip, and a fulcrum means for tilting of said member to move said tip thereof from a first non-selected normal position to a second selected position;

a movement element positioned for relative movement with respect to said selector members adjacent said selector members, said movement element comprising means for receiving said control pulses, for causing movement about said fulcrum means of said selector members corresponding to said selected needles, and for causing movement of the tips of said thus selected selector members, into said selected position, with respect to the remainder of said selector members;

a deflector fixedly positioned with respect to said movement element and having a separator tip positioned to contact said tips of said selected selector members, and wedge means contiguous with said separator tip for moving said selected selector members toward said respective needles to cause movement of said selected needles from said non-knitting position; and a needle deflector fixedly positioned with respect to said movement element and having an apex with an edge having a tip means for contacting and moving said selected needles into said knitting position.

2. A needle selection mechanism as claimed in claim 1, wherein said movement element comprises a piezoelectric element solidly positioned with respect to said deflector and having a free end having a wedge of hard metal or sintered ceramic, said wedge having a face pointed in the direction of relative movement of said member towards said selector members, said wedge face having a length equal to one needle pitch.

3. A needle selection mechanism as claimed in claim 1, wherein said movement element comprises an electromagnet having poles lying one above the other and inclined to the direction of relative movement of said selector members at an angle of from 15° to 30°, said electromagnet poles having a surface aligned oblique to said direction.

4. A needle selection mechanism as claimed in claim 1, wherein said needle deflector is pivotally mounted to be movable from a lower oblique position in which all the needles are moved, to an upper less oblique position; and wherein each said needle has a foot with a pointed tip for contact by said needle deflector.

5. A needle selection mechanism as claimed in claim 4, further comprising a second needle deflector adjustable among three positions.

6. A needle selection mechanism as claimed in claim 1, wherein said knitting machine is a straight bar knitting machine having a lifting cam movable to and fro with respect to said needles, said movement element being integral with said lifting cam and having a fulcrum which coincides with a centreline of said scanning means; wherein said movement element comprises an electromagnet having poles, one edge of which coincides on a line with one boundary of a control-field as well as with the one boundary of a needle-pitch; and wherein said lifting cam and electromagnet are mounted on a block which can slide to and fro underneath a track of said lifting cam.

7. A needle selection mechanism as claimed in claim 1, wherein said electromagnet pivots about said fulcrum, whereby an edge of said poles lying nearer to said selector members always is upstream and on said centreline; and wherein said poles are surrounded by a non-magnetic bonding material by which at both sides of said poles a guiding edge is formed.

8. A needle selection mechanism as claimed in claim 1, wherein each said selector member has a lever portion projecting from the fulcrum thereof.

9. A needle selection mechanism as claimed in claim 1, wherein said member comprises a needle bed having a recess therein continuous with said needle tracks, a channel connected with said recess, said selector members each having a head rotatably positioned in said channel, and segments with spacer teeth mounting said selector members therein.

10. A needle selection mechanism as claimed in claim 1, further comprising angular separator-segments mounting said selector members in place and having transverse slots at the same pitch as said needles, and webs between said slots having bulges creating constructions to prevent involuntary passage into said slots of said selector members.

11. A needle selection mechanism as claimed in claim 1, wherein said control member has a surface divided in accordance with the desired knitting pattern into rows of rectangular control-fields, the boundaries of which agree in the direction of scanning exactly with the boundaries of the needle pitch, certain of said control-fields being white and the others black, said scanning means being a photoelectric element so that the white control-fields upon photoelectric reading thereof omit a current pulse, a signal which persists from one boundary of a control-field to another, or across a number of control-fields together in a row.

12. A needle selection mechanism as claimed in claim 11, wherein said control-fields are divided according to a single standard size the boundaries of which are rectangular and in the direction of scanning are coincident with the boundaries of the needle pitch.

13. A needle selection mechanism as claimed in claim 1, wherein said control member comprises an endless belt mounted on a cylinder; a toothed belt for moving said cylinder; and a gearwheel continuously engaging said toothed belt.

14. A needle selection mechanism as claimed in claim 1, wherein said selector members are guided on one side thereof in guide slots by an endless spiral spring which is positioned in a groove.

15. A needle selection mechanism as claimed in claim 1, wherein said member comprises a needle bed having being positioned a groove, said selector members beingpositioned in said groove without play; and each having a head and an endpiece underneath which bar permanent magnets are arranged for pulling said selector members across a small airgap into said groove.

16. A needle selection mechanism as claimed in claim 1, wherein said control member includes a belt having rows of said control-fields, only every other said row in the succession of rows being used for storage of the pattern.

17. A needle selection mechanism as claimed in claim 1, wherein each said selector member has a rotary head forming said fulcrum means, a shank extending toward said tip, a guidepiece on said shank adjacent said tip and extending towards the bottom of the respective needle track, and adjacent said fulcrum means a foot projecting out of said needle track; and further comprising a straightener wedge means for alignment of said selector members; and wherein said deflector comprises a slider-wedge having said separator tip thereof sloping downwards for engaging said guidepiece of a selected selector member.

18. A needle selection mechanism as claimed in claim 1, wherein said movement means comprises an electromagnet having two poles arranged one above the other in the longitudinal direction of said selector members and obliquely to the direction of relative movement thereof.

19. A needle selection mechanism as claimed in claim 18, wherein said electromagnet remains stationary, and said magnet poles are symmetrically chamfered from the center thereof on both sides thereof in said direction, the thus chamfered pole faces forming means for, upon receipt of a pulse, pulling a selected selector member into contact therewith.

20. A needle selection mechanism as claimed in claim 18, wherein each said selector member has a widened head in the form of a bead with a convex surface forming means for concentrating the field of force of said two magnet poles for better attraction of said selected selector members.

21. A needle selection mechanism as claimed in claim 18, further comprising a raising wedge means positioned adjacent said electromagnet for engaging beneath said tips of said selector members for positioning said selector members close to said magnet poles so that only a small airgap remains therebetween.

22. A needle selection mechanism as claimed in claim 1, wherein said separator tip of said deflector is positioned beneath the line of passage of said tips of said selector members; and said separator tip has a polished knife edge, whereby said tips of selected of said selector members need be raised only slightly to be above said edge.

23. A needle selection mechanism as claimed in claim 1, wherein said control member comprises an endless belt of transparent material upon which negative control-fields are formed as opaque fields in rows in accordance with a desired knitting pattern; and said scanning means comprises an adjustable scanning-head positioned outside said belt and including a light detection means, a light source positioned inside said belt, and a reflector concentrating light from said source toward said belt and light detection means; said scanning means being adjustably movable between rows on said belt.

24. A needle selection mechanism as claimed in claim 1, wherein said member comprises a needle bed having a recess beneath said needle tracks; and each said selector member includes a shank with a portion thereof bent downwardly into said recess; said recess having a face rising obliquely towards said needle tracks; said bent portion having a bevel end contacting said oblique recess face.

25. A needle selection mechanism as claimed in claim 1, further comprising a pushrod movably positioned in each needle track, each pushrod having a recess therein; and wherein each said selector member comprises a rounded head positioned within a said recess of a respective pushrod and rockable therein within limits and tapering into said tip.

26. A needle selection mechanism as claimed in claim 25, wherein said separator tip of said deflector comprises an edge extending from said tips first obliquely downwards in the direction of movement of said pushrods and then obliquely in a direction across said needle tracks.

27. A needle selection mechanism as claimed in claim 25, wherein said movement means comprises an electromagnet; and wherein the portion of said selector member extending from said needle track is thicker than said rounded head.

28. A needle selection mechanism as claimed in claim 25, further comprising straightener face means for accurately aligning said selector members; and straightener wedge means for aligning said pushrods.

29. A needle selection mechanism as claimed in claim 1, wherein said movement means comprises a moving coil having a plunger magnet, and a winding connected to control leads and providing means for movement by positive current pulses into an operating position and by negative current pulses out of said operating position; and wherein a desired knitting pattern is provided on said control member in the form of equal groups of control-fields in rows side by side, and with no interruptions between the same groups in a given row, whereby the same signal persists from the starting boundary of one group of control-fields to the terminal boundary thereof, such that said moving coil does not have to make intermediate movements.

30. A needle selection mechanism as claimed in claim 29, wherein said coil is injection moulded from plastic material and has a thin wall, a cylindrical portion formed for said winding, and a cone with internal stiffening webs extending to form a small guide tube.

31. A needle selection mechanism as claimed in claim 30, wherein said coil is guided at one side thereof at said guide tube in a guide bush and at the other side thereof at said cylindrical portion on a pole plate; said cylindrical portion having a plurality of guide ribs fitting in recesses in said pole plate.

32. A needle selection mechanism as claimed in claim 31, further comprising a wedge of hard metal cemented in said guide tube; and a sheet of aluminum coating the surface of said cylindrical portion and said cone and forming means for heat dissipation.

33. A needle selection mechanism as claimed in claim 29, wherein each said selector member is suspended in a respective needle track on a wire forming said fulcrum means and is held therein by a ring spring.

34. A needle selection mechanism as claimed in claim 29, further comprising a pushrod with a pointed foot positioned in each said needle track; and wherein each said selector member comprises a rocker arranged transversely to the respective said pushrod and supported to oscillate; and wherein said deflector comprises a separate roller, and said separator tip comprises a sharp edge on said roller.

* * * * *